US007234332B2

(12) United States Patent
Kutschker

(10) Patent No.: US 7,234,332 B2
(45) Date of Patent: Jun. 26, 2007

(54) BENDING MACHINE

(75) Inventor: Wolfgang Kutschker, Böblingen (DE)

(73) Assignee: RAS Reinhardt Maschinenbau GmbH (DE)

( * ) Notice: Subject to any disclaimer, the term of this patent is extended or adjusted under 35 U.S.C. 154(b) by 76 days.

(21) Appl. No.: 11/088,442

(22) Filed: Mar. 24, 2005

(65) Prior Publication Data

US 2005/0160781 A1 Jul. 28, 2005

Related U.S. Application Data

(63) Continuation of application No. PCT/EP03/006731, filed on Jun. 26, 2003.

(30) Foreign Application Priority Data

Sep. 26, 2002 (DE) ..... 102 45 777

(51) Int. Cl.
*B21D 5/04* (2006.01)

(52) U.S. Cl. ..... 72/20.1; 72/319

(58) Field of Classification Search ..... 72/319, 72/316, 20.1, 20.2
See application file for complete search history.

(56) References Cited

U.S. PATENT DOCUMENTS 4,449,389 A 5/1984 Cros
4,768,367 A * 9/1988 Favrin ..... 72/319
5,176,017 A * 1/1993 Tokai ..... 72/6.1
5,239,853 A * 8/1993 Kutschker ..... 72/319
6,058,756 A 5/2000 Kutschker

FOREIGN PATENT DOCUMENTS

DE 2534664 A1 2/1977
DE 19735793 A1 3/1999
WO WO 99/10116 3/1999

* cited by examiner

*Primary Examiner*—Daniel C. Crane
(74) *Attorney, Agent, or Firm*—Reinhart Boerner Van Deuren P.C.

(57) ABSTRACT

The invention concerns a bending machine comprising a machine frame, and upper bar and a lower bar mounted on the frame and mutually mobile, a bending bar mounted on the frame, a bending bar mounted on the frame and mobile relative to the frame, to the upper bar and to the lower bar, said bending bar being provided with a support and a bending tool pressing on said support via a bending device actuated by a control unit. The invention aims at making the bending adjustment faster and more accurate. Therefor, said bending device is equipped with an adjusting device capable of being used during a bending operation; the adjusting device, which is actuated by the control unit, can be controlled during a bending operation; at least one sensor associated with the control unit enables detection, through the adjusting device of an adjustment performed by the control unit. For a given bending operation, the control unit determines at least one bending parameter for the bending device, the bending bar tool being set in a substantially flexure-free position at the end of the bending operation.

23 Claims, 6 Drawing Sheets

BENDING MACHINE

This application is a continuation of international application number PCT/EP2003/006731 filed on Jun. 26, 2003.

The present disclosure relates to the subject matter disclosed in international application number PCT/EP2003/006731 of Jun. 26, 2003 and German application number 102 45 777.8 of Sep. 26, 2002, which are incorporated herein by reference in their entirety and for all purposes.

BACKGROUND OF THE INVENTION

The invention relates to a bending machine, comprising a machine frame, an upper beam and a lower beam, both of which are held on the machine frame and can move relative to one another, a bending beam, which is held on the machine frame, can move with respect to the latter and with respect to the upper beam and lower beam and has a bending beam carrier and a bending beam tool that is supported on the bending beam carrier via a curving device actuable by a control unit.

Bending machines of this type are known from the prior art.

In these bending machines, the curving device is set manually, it being necessary to establish the appropriate setting of the curving device for a defined bending operation by means of a series of tests.

The invention is based on the object of improving a bending machine of the generic type in such a manner that the curving device can be set more quickly and more precisely.

SUMMARY OF THE INVENTION

In a bending machine of the type described in the introduction, this object is achieved, according to the invention, through the fact that the curving device is provided with a setting device operable during a bending operation, that the control unit can actuate the setting device even during a bending operation, that at least one sensor is provided, which is associated with the control unit and can be used by the control unit to determine a setting of the curving device by the setting device, and that for a defined bending operation the control unit can determine at least one setting parameter for the curving device for which the bending beam tool is oriented substantially without any deflection when this bending operation has ended.

The advantage of the solution according to the invention is that it offers the option on the one hand of using the control unit to set the curving device during a bending operation and on the other hand of the control unit determining at least one setting parameter for the curving device for a defined bending operation, for which the bending beam tool is oriented substantially without any deflection when this bending operation has ended.

This at least makes it possible to set the curving device, even during a bending operation, in such a way that when the bending operation has ended the bending beam tool is oriented without any deflection and therefore the workpiece that has been bent by the bending beam tool, even after the operation has ended, has the precise degree of bending corresponding to the deflection-free orientation of the bending beam tool.

The number of setting parameters may differ in the solution according to the invention.

The simplest solution provides for the at least one setting parameter to be a single setting parameter, namely the maximum setting parameter which occurs during the defined bending operation.

A more precise setting of the curving device, which in particular is matched to individual bending regions during the course of the bending operation, is possible if the curving device can be set according to a multiplicity of setting parameters during the defined bending operation.

By way of example, the control unit sets the setting parameters which exactly correspond to the bending states to be passed through during the bending operation.

In principle, it would be conceivable to determine the setting parameter by determining the setting parameter from a table stored in the control unit based on workpiece data and data of the bending operation. A procedure of this nature always entails inaccuracies.

According to the invention, the object which was set in the introduction is also achieved, as an alternative or in addition to the embodiments of the solution according to the invention described above, by the fact that the at least one setting parameter for a defined bending operation can be determined by a measurement by the control unit while this bending operation is being carried out.

The determining of the at least one setting parameter by means of a measurement is conceivable in a very wide range of ways.

By way of example, it would be conceivable to record the rectilinear orientation of the bending beam tool by a measurement while the bending operation is being carried out and always to set the curving device in such a way that the rectilinear orientation of the bending beam tool is retained. In this case, the setting parameters are determined by the control unit by means of the constant readjustment of the curving device such that the bending beam tool remains oriented straight, and at the same time as the determination of these setting parameters the curving device is set accordingly.

An alternative solution to this solution provides that the control unit as part of a measurement for determining the at least one setting parameter records the deflection of the bending beam carrier by means of at least one sensor.

Determining the deflection of the bending beam carrier has the advantage that there is therefore no need for any measurement whatsoever in the region of the bending beam tool and in particular for any measurement whatsoever of the straight orientation of the bending beam tool during the bending operation, and consequently in this solution the at least one setting parameter can be recorded in a particularly favorable way during the bending operation.

A very wide range of options are conceivable in terms of the way in which the deflection of the bending beam carrier is recorded.

By way of example, it would be conceivable for the deflection of the bending beam carrier to be recorded at a plurality of locations thereof.

However, for reasons of simplicity, it has proven particularly advantageous if the at least one sensor records the deflection of the bending beam carrier at a single location thereof.

By way of example, it would be possible to record the deflection of the bending beam carrier by means of a strain gauge, which could be disposed on that side of the bending beam carrier which extends.

However, for reasons of simplicity it has proven expedient if the at least one sensor records the deflection of the bending beam carrier with respect to a reference position, so that there is no need to determine the zero position, which may present problems for a strain gauge.

A very wide range of solutions are conceivable with regard to the predetermining of the reference position.

For example, it would be conceivable for the reference position to be predetermined by a light beam.

However, a particularly simple solution provides for the reference position to be predetermined by a reference element.

A reference element of this type can be provided in a very wide range of ways. One expedient solution provides for the reference element to be a reference carrier which extends parallel to the bending beam carrier.

A number of variants are likewise conceivable with regard to the way in which the sensor operates in the case of a reference element. It is particularly expedient if the at least one sensor records a change in the relative position of the bending beam carrier with respect to the reference carrier.

The deflection of the bending beam carrier can now be linked to the setting parameter that is to be determined in a very wide range of ways. A solution which is particularly expedient on account of its simplicity provides that the control unit determines the setting parameter for the curving device on the basis of the deflection of the bending beam carrier and adjustment properties of the curving device.

The explanation of the invention which has been given thus far has not provided any further details as to the way in which the setting of the curving device is to be recorded by the sensor. By way of example, according to an advantageous solution the control unit records the setting of the curving device by means of at least one position sensor associated with the curving device.

In this context, it is preferable for the position sensor to be disposed at an end of the curving device.

It is particularly expedient if a position sensor is disposed at each of the two ends of the curving device, in order for the setting of the latter to be determined particularly accurately.

The explanation of the individual exemplary embodiments that has been given thus far has not provided any further details as to the setting of the curving device.

By way of example, it is conceivable that the curving device can be set in accordance with the setting parameter by means of the control unit during a bending operation, in which case either the setting parameter may also be determined during the bending operation or the setting parameter has already been determined before the bending operation is carried out.

This solution has the advantage that the setting of the curving device can at least approximately be realized in such a way that the curving device likewise approximately provides a rectilinearly oriented bending beam tool during the bending operation.

As has already been explained in the introduction, in the context of the solution according to the invention it is in principle sufficient if the curving device, when the bending operation has ended, is set in such a way that the bending beam tool is in a substantially rectilinear orientation, since this makes it possible, all the way through to the end of the bending operation, to compensate for any inaccuracies resulting from temporary deflection of the bending beam tool during the bending operation.

However, it is particularly expedient if the control unit, by actuation of the setting device, sets the curving device according to the deflection of the bending beam carrier which is established at individual times while the bending operation is being carried out.

It is particularly expedient if the curving device can be set in accordance with the setting parameter by means of the control unit while the setting parameter is being recorded, so that direct conversion of the recorded setting parameter into the setting of the curving device is effected.

By way of example, conversion of the recorded setting parameter of this nature into the setting of the curving device is also possible if the setting parameter is defined by measuring the rectilinear orientation of the curving device.

However, this is of course also possible if the setting parameter is recorded by recording the deflection of the bending beam carrier.

As an alternative, in particular if the setting parameter has been determined even before the bending operation, there is also the possibility that the curving device can be set to the at least one setting parameter before the defined bending operation is carried out.

A solution in which the curving device can be set according to the setting parameter in any operating state, is particularly expedient.

In the context of the description given thus far of the individual functions of the control unit, it has been explained that the control unit, in order to carry out a defined bending operation, determines the setting parameter for this defined bending operation while it is being carried out.

However, this does not necessarily mean that the at least one setting parameter has to be determined afresh each time the defined bending operation is carried out.

By way of example, it is conceivable that the control unit at least approximately determines the at least one setting parameter before another of the defined bending operations is carried out.

This means that the at least one setting parameter can be determined while a defined bending operation is being carried out, but this determined setting parameter is not used only for the setting of the curving device during this one defined bending operation, but rather also can also be used during others of the defined bending operations, i.e. for example during the production of further identical parts with the defined bending operation being carried out repeatedly.

This solution makes it possible for the at least one setting parameter determined during the preceding defined bending operation to be used during these others of the defined bending operation at least for faster setting of the curving device, since the fact that the setting parameter is approximately known makes it possible to initiate setting of the curving device to this approximate value and therefore for the measurement in such a situation merely to compensate for deviations from the approximate value, which it would have to compensate for by additional control of the curving device.

However, it is even more advantageous if the control unit substantially precisely determines the at least one setting parameter before another of the defined bending operations is carried out, since in this case, if the at least one setting parameter is recorded as part of a bending operation, the same at least one setting parameter could be used for the further bending operations.

Nevertheless, even if the at least one setting parameter has been determined substantially precisely, it would still be possible to measure and check the setting as before.

It has proven particularly expedient if the curving device can be preset by means of the control unit before the defined bending operation is carried out.

A presetting of this type makes it possible to achieve a range of advantages. One advantage would be that by presetting at least to a partial value of the at least one setting parameter it is possible to shorten the response time of the curving device for the setting and therefore to carry out the setting of the setting parameter more quickly and more precisely.

Another advantage is that it is possible to determine the setting parameters in each case during one of the defined bending operations, namely the first one of the defined bending operations, and to carry out all of the other defined bending operations using these setting parameters.

In the case of a presetting, there is the option of setting to at least a partial value of the assumed setting parameter, in which case this partial value can be taken to be lower than the assumed setting parameter.

In order, in particular in the case of bending operations using intensive force, to facilitate the setting of the curving device and therefore also to improve the setting speed and setting precision thereof, it is preferably provided that the curving device can be preset by means of the control unit to a value which is above an assumed setting parameter and can then be reduced to the setting value during the bending operation.

This presetting of the setting parameter to above the assumed setting parameter, i.e. to values which are higher than it, has the advantage that it is therefore possible during the bending operation to use the bending forces acting on the curving device in addition to the force generated by the setting device to displace the curving device, namely toward lower values of the setting parameters, i.e. from a higher curvature toward a lower curvature, so that as a result lower setting forces are required and the curving device can also be set more quickly.

In this context, the excessive curving at the start of the bending operation is not disadvantageous, provided that it is ensured that at the end of the bending operation the curvature which is set corresponds to the deflection of the bending beam carrier.

A very wide range of solutions are conceivable with regard to the determination of an assumed setting parameter of this type. For example, a particularly expedient solution provides that the assumed setting parameter can be determined by the control unit in such a manner that the actual setting parameter determined after part of a bending angle associated with a bending operation has been passed through is used.

It is particularly advantageous if the at least one setting parameter which has been determined once for a bending operation is used further by the control unit as setting parameter during others of the defined bending operations, since in this case the actual determination of the setting parameter, for example by measurement, is carried out only for one or a few of the defined bending operations, and this one setting parameter can then be used for all of the other defined bending operations, making it possible to save on the time required for the measurement for determining the setting parameter.

With this solution it would be conceivable, for example, to carry out one of the defined bending operations slowly and to determine the at least one setting parameter during this one of the defined bending operations, in order then for the others of the defined bending operations to be carried out very quickly, since the at least one setting parameter has already been determined for them and can then continue to be used each time.

Further features and advantages of the invention form the subject matter of the following description and of the illustration of an exemplary embodiment in the drawing.

BRIEF DESCRIPTION OF THE DRAWINGS

in FIG. 6*b*: illustrates the setting parameters for setting of the curving device plotted against the bending angle for various operating modes.

DETAILED DESCRIPTION OF THE INVENTION

Figure 1:
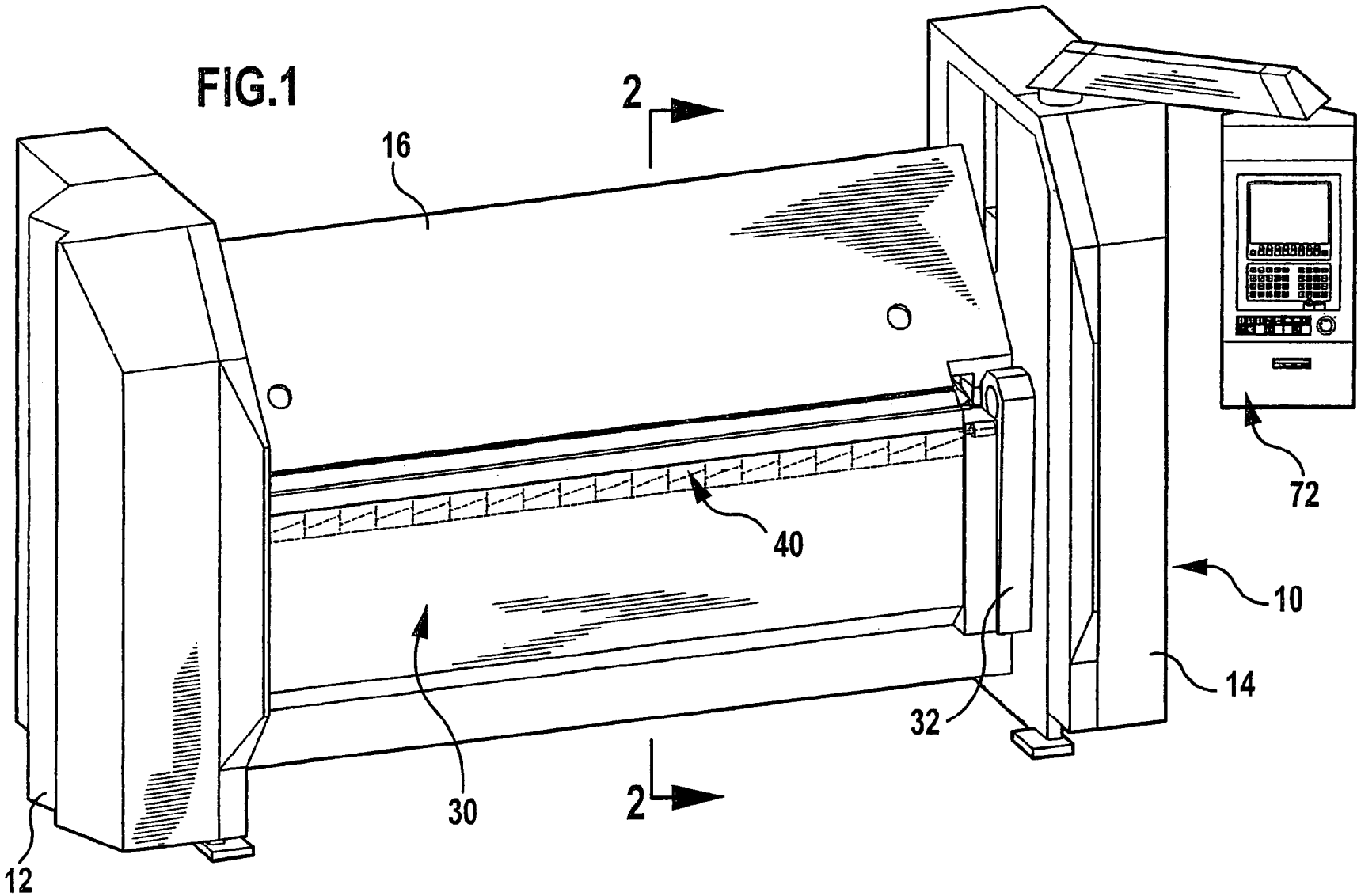
FIG. 1 shows a front view of a bending machine according to the invention with the curving device also indicated.
Figure 2:
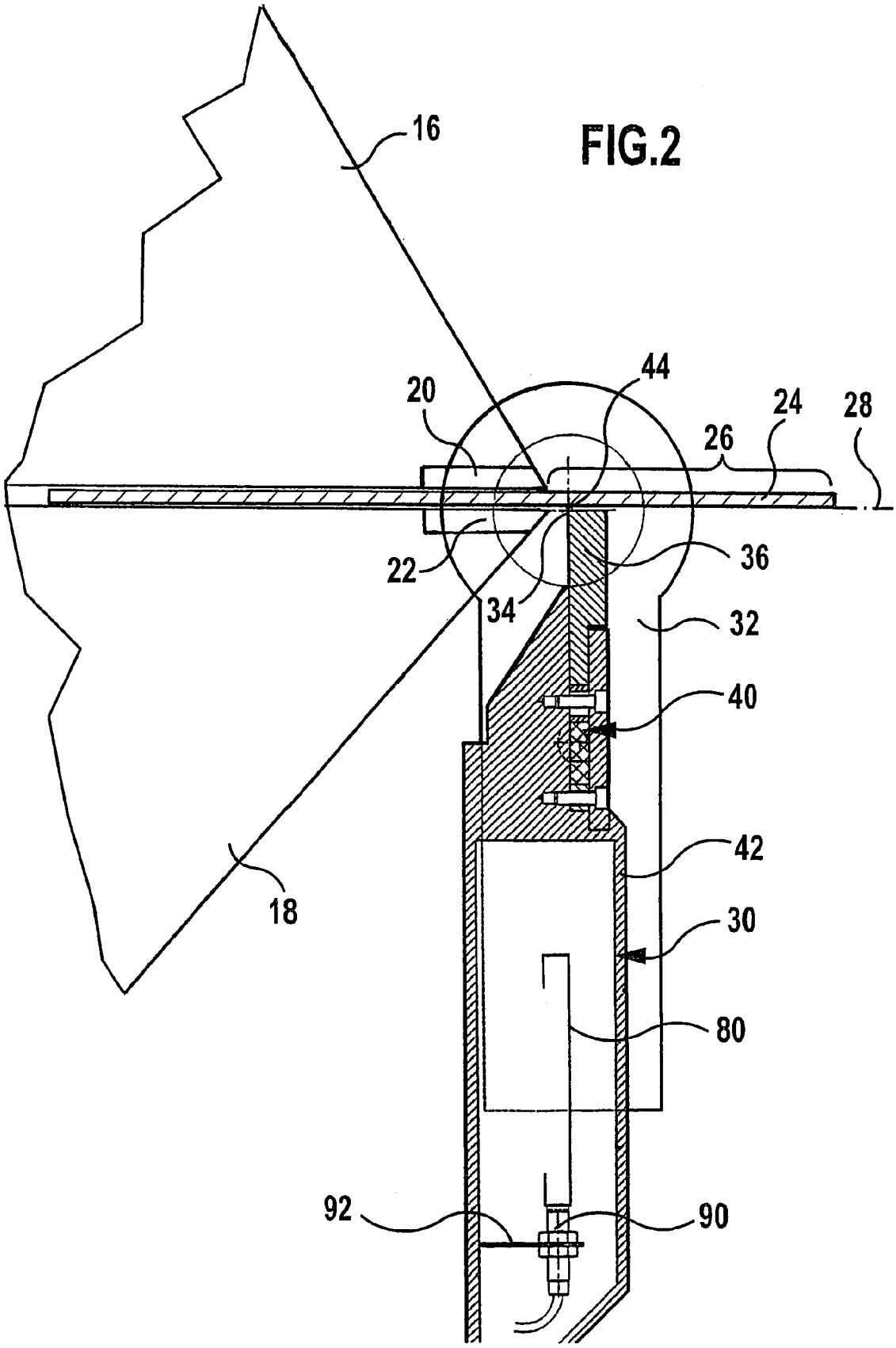
FIG. 2 shows a section on line 2—2 in FIG. 1.

An exemplary embodiment of a bending machine according to the invention, illustrated in FIG. 1, comprises a machine frame 10 with side columns 12 and 14, between which, as illustrated in FIGS. 1 and 2, an upper beam 16 and a lower beam 18 extend.

By way of example, the lower beam 18 is fixed to the columns 12 and 14 and the upper beam 16 can move relative to the lower beam 18.

Furthermore, the upper beam carries an upper beam tool 20 and the lower beam carries a lower beam tool 22, between which a workpiece 24 made from flat material, for example a metal sheet, can be clamped in such a way that a strip 26 of it which projects beyond the upper beam tool 20 and the lower beam tool 22 can be bent out of a clamping plane 28 defined by the lower beam tool 22 and the upper beam tool 20.

For this purpose, the bending machine is provided with a bending beam 30, which extends between bending beam holders 32 disposed at its ends and can be pivoted with these bending beam holders 32 about a pivot axis 34, the pivot axis 34 preferably being above and parallel to the clamping plane 28.

The bending beam 30 acts on the strip 26 of the workpiece 24 that is to be bent by means of a bending beam tool 36, the bending beam tool 36 being supported via a curving device 40 on a bending beam carrier 42 of the bending beam 30, and the bending beam carrier 42 being provided for the purpose of absorbing the forces which act on the bending beam tool 36 and thereby keeping the bending beam tool 36 dimensionally stable.

Ideally, the bending beam tool 36 would be kept dimensionally stable in such a manner that its bending edge 44 extends exactly parallel to the pivot axis 34, irrespective of the reaction forces acting on the bending beam tool 36 during bending of the workpiece 24.

Since the bending beam 30 extends over great lengths between the side columns 12, 14, more or less pronounced deflection of the bending beam carrier 42 and therefore corresponding deflection of the bending beam tool 36 occur depending on the type of workpiece 24 that is to be bent—in particular its material, thickness and length—the position of the workpiece 24 that is to be bent and the angle which is to be bent, unless this deflection is counteracted by the curving device 40. The curving device 40, via which the bending beam tool 36 is supported on the bending beam carrier 42, is formed in such a way that it opens up the possibility, as illustrated in FIGS. 3 and 4, of bending the bending beam tool 36 relative to the bending beam carrier 42 in the opposite direction to its deflection, and thereby of compensating for the deflection of the bending beam carrier 42, which absorbs the bending forces, in such a way that the bending edge 44 of the bending beam tool 36 once again extends substantially parallel to the pivot axis 34, which simultaneously constitutes the bending line.

Figure 3:
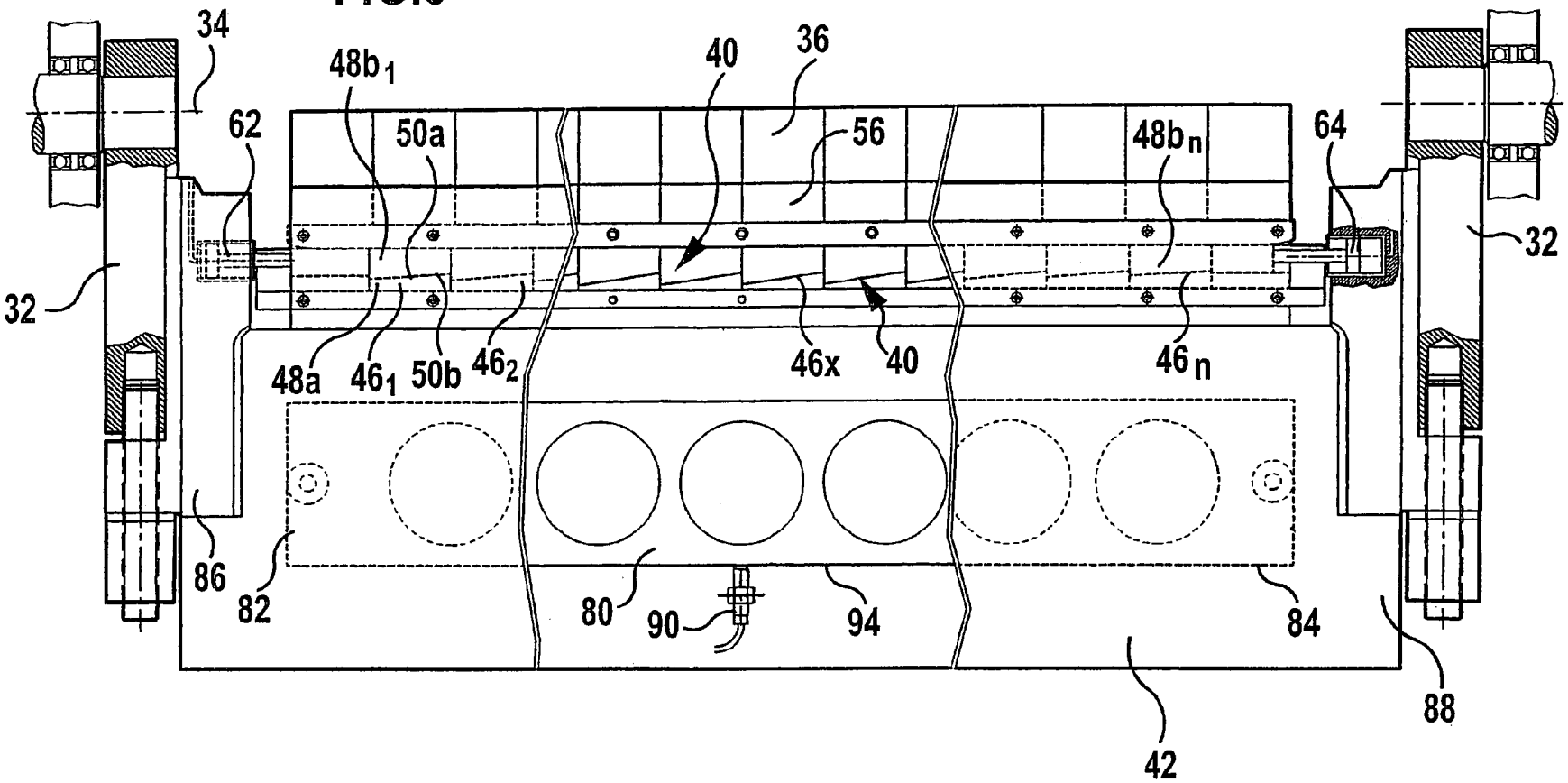
FIG. 3 shows an enlarged illustration of a bending beam of the bending machine according to the invention, with regions partially cut away in order to reveal the curving device and a reference carrier.
Figure 4:
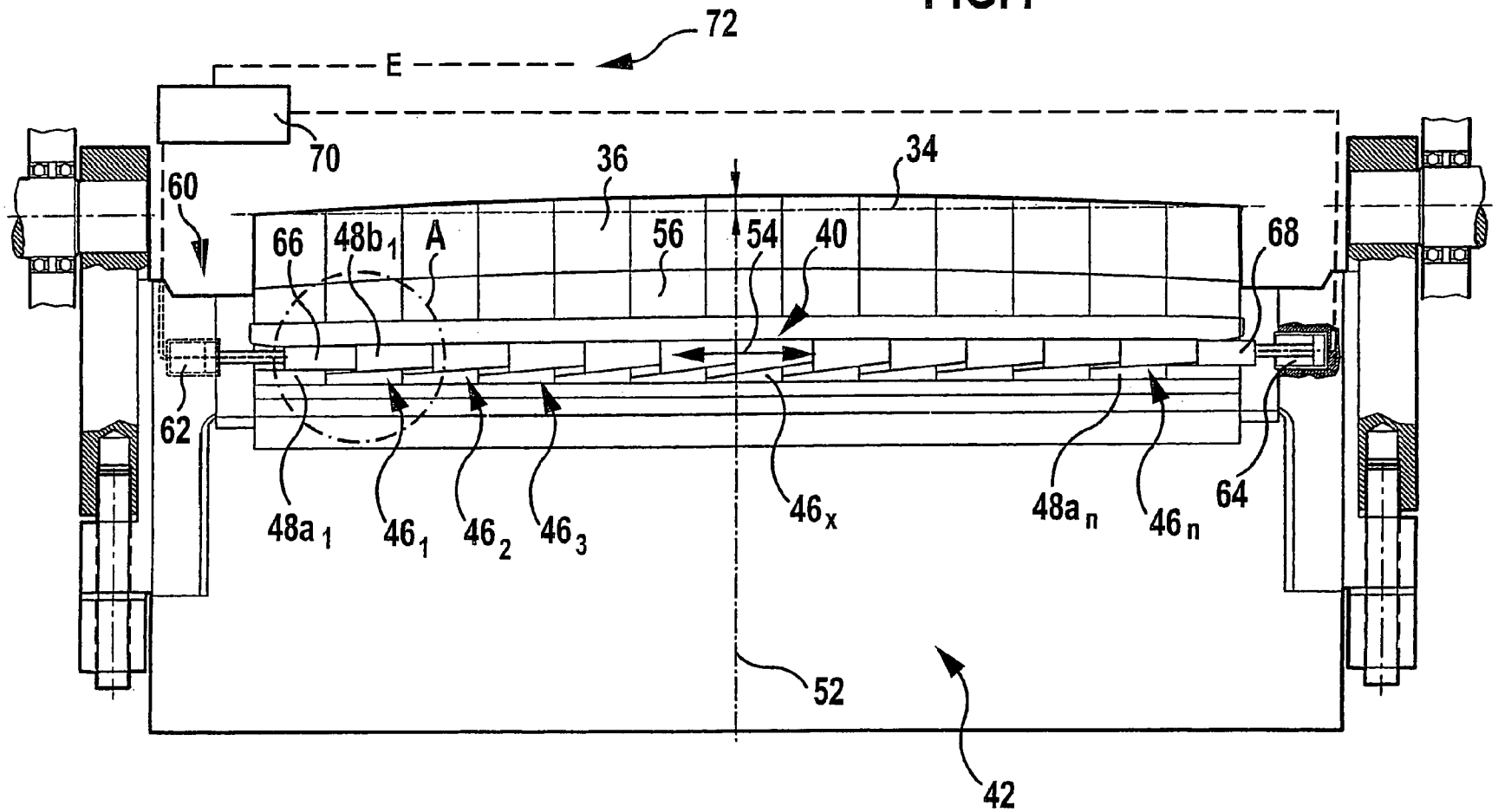
FIG. 4 shows an illustration similar to FIG. 3, with the curving device substantially visible.
Figure 5:
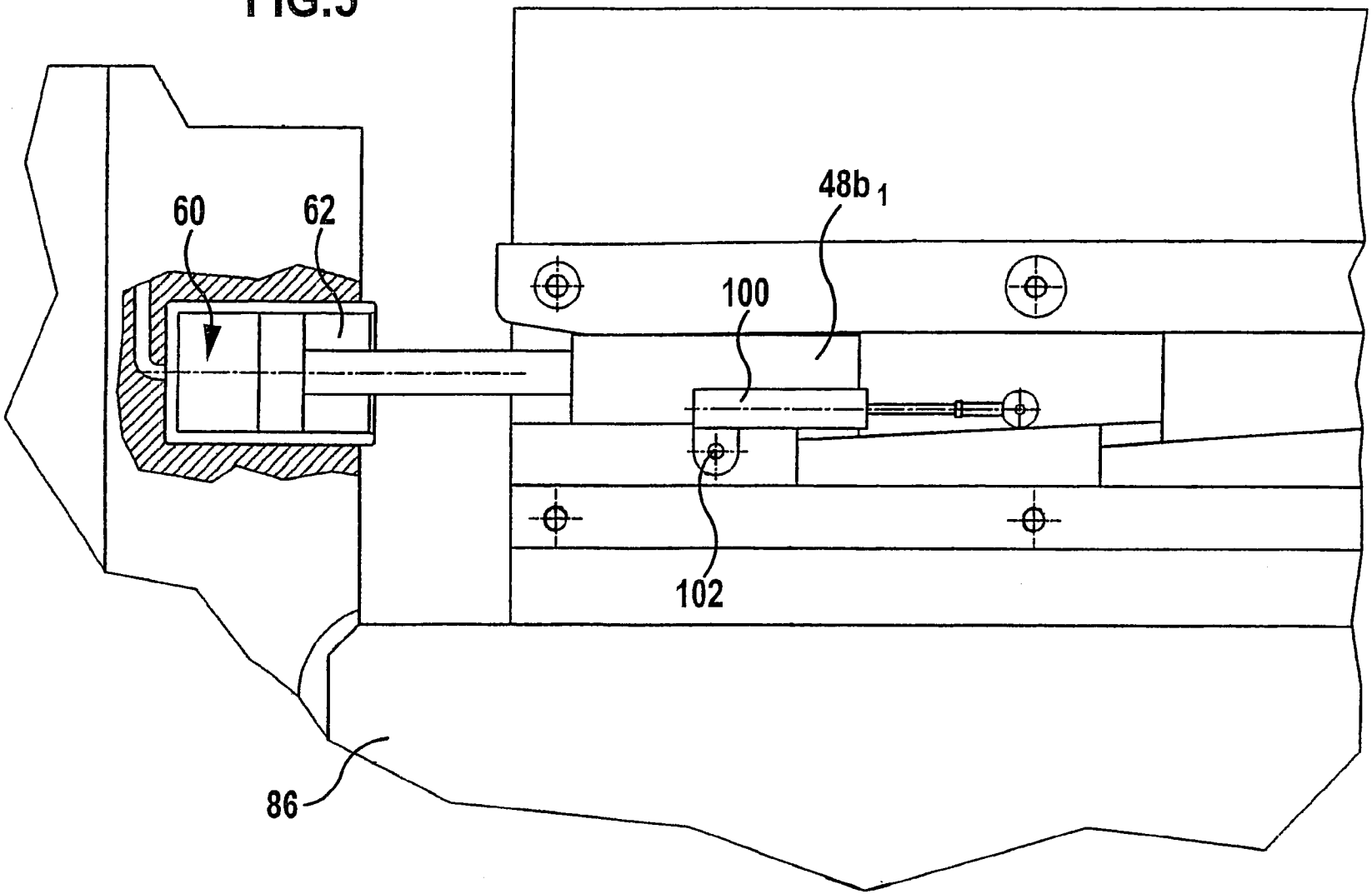
FIG. 5 shows an enlarged illustration of a region A in FIG. 4.

For this purpose, as illustrated in FIGS. 3 and 4, the curving device 40 is provided with successively disposed wedge pairs $\mathbf{46}_1$ to $\mathbf{46}_n$, which each comprise a lower wedge body 48*a*, which is in a fixed position on the bending beam carrier 42, and an upper wedge body 48*b* which is positioned on the lower wedge body 48*a*, the mutually facing wedge surfaces 50*a* and 50*b* of which wedge bodies 48*a* and 48*b*, respectively, engage against one another such that they can slide along one another.

Furthermore, the wedge angle of the wedge surfaces 50*a, b* of different wedge pairs $\mathbf{46}_1$ to $\mathbf{46}_n$ varies, specifically in such a manner that the wedge angle is smallest at each of the outermost wedge pairs $\mathbf{46}_1$ and $\mathbf{46}_n$ and increases continuously towards a center line 52, so that the inclination of the wedge surfaces 50*a, b* is greatest at the central wedge pair(s) $\mathbf{46}_x$.

Furthermore, the upper wedge bodies $\mathbf{48}b_1$ to $\mathbf{48}b_n$ are displaceable in a longitudinal direction 54 of the curving device 40, which simultaneously also corresponds to a longitudinal direction of the bending beam 30, with respect to the lower wedge bodies $\mathbf{48}a_1$ to $\mathbf{48}a_n$ and with respect to a bending beam tool receiving part 56 disposed between the bending beam tool 36 and the upper wedge bodies $\mathbf{48}b_1$ to $\mathbf{48}b_n$, with upper wedge bodies 48*b* which in each case follow one another in the longitudinal direction 54 engaging against one another, so that all the upper wedge bodies 48*b* can be displaced simultaneously and over the same path in the longitudinal direction 54.

On account of the different angle of inclination of the wedge surfaces 50*a, b* of the wedge pairs $\mathbf{46}_1$ to $\mathbf{46}_n$, a displacement of the upper wedge bodies 48*b* in the vicinity of the center line 52 of the curving device 40 effects greater deflection of the bending beam tool 36 in the direction away from the bending beam carrier 42 than in the region of the outer wedge pairs $\mathbf{46}_1$ and $\mathbf{46}_n$, as illustrated in FIG. 4.

On account of the curving device 40 being adjustable in this way, it is possible for different degrees of deflection of the bending beam carrier 42 in the direction away from the pivot axis 34 to be compensated for to different extents in a corresponding way by the curving device 40, so that the bending edge 44 can approximately be set in such a way as to extend approximately parallel to the pivot axis 34 and therefore also to the bending line.

It is therefore possible to substantially compensate for the deflection of the bending beam carrier 42 as a function of the bending forces which occur during different bending operations.

To adjust the curving device 40, a setting device is provided, this setting device being denoted overall by 60 and comprising hydraulic cylinders 62 and 64 which are respectively associated with end-side wedge pairs $\mathbf{46}_1$ and $\mathbf{46}_n$ and act on the respective upper wedge body $\mathbf{48}b_1$ and $\mathbf{48}b_n$, respectively, by means of pressure-exerting bodies 66 and 68, with in each case one of the hydraulic cylinders 62 or 64 being active.

By way of example, if the upper wedge bodies 48*b* are to be displaced in the direction of the hydraulic cylinder 64, the hydraulic cylinder 62 is active, while if the upper wedge bodies 48*b* are to be displaced in the direction of the hydraulic cylinder 62 the hydraulic cylinder 64 is active.

To actuate and operate the two hydraulic cylinders 62 and 64, the setting device 60 is also provided with a hydraulic control unit 70, which can be used to apply hydraulic medium to the two hydraulic cylinders 62 and 64 in a controlled way.

The hydraulic control unit 70 corresponds with a control unit 72 for the bending machine.

To enable a correct setting parameter for the curving device 40 to be determined, in the exemplary embodiment illustrated the control unit 72 is able to record the deflection of the bending beam carrier 42.

It is preferable for the bending beam carrier 42 to be formed as a hollow body, so that a reference carrier 80 can be disposed in the bending beam carrier 42, which reference carrier 80 likewise extends substantially over the length of the bending beam carrier 42 in the longitudinal direction 54 thereof and, in the region of its two ends 82 and 84, is held on the bending beam carrier 42 in the vicinity of its end regions 86, 88 that are connected to the bending beam holders 32.

The reference carrier 80 runs within the bending beam carrier 42, in such a manner that it is not subject to any loads and therefore also cannot be deflected with the bending beam carrier 42 when load is applied to the latter during the bending operation.

The reference carrier 80 therefore constitutes a geometric reference compared to which the deflection of the bending beam carrier 42 can be determined.

For this purpose, a first sensor 90 connected to the bending beam carrier 42 is provided in the latter, preferably in the region close to the center line 52, which first sensor is connected to the bending beam carrier 42, by way of example, by means of a holding angle bracket 92.

The first sensor 90 records the distance between itself and a lower edge 94 of the reference carrier 80, this distance increasing with increasing deflection of the bending beam carrier 42, so that the distance from the lower edge 94 recorded by the first sensor 90 corresponds to the maximum deflection of the bending beam carrier 42.

The first sensor 90, connected to the control unit 72, therefore provides a measure of the maximum deflection of the bending beam carrier 42 when bending forces act on the bending beam tool 36.

The control unit 72 is able, in accordance with the maximum bending measured by the first sensor 90 to determine setting parameters E for the curving device 40 and to actuate the hydraulic control unit 70 accordingly, so that hydraulic medium is applied to the appropriate hydraulic cylinder 62 or 64.

To make it possible to determine the extent to which the upper wedge body 48*b* is displaced by the hydraulic cylinders 62 or 64, second sensors 100 are associated with the respectively outermost upper wedge bodies $\mathbf{48}b_1$ and $\mathbf{48}b_n$, which second sensors 100 in each case determine a position of the outermost upper wedge body $\mathbf{48}b_1$ and $\mathbf{48}b_n$ relative to a fixed point 102, which is disposed at a fixed position relative to the bending beam carrier 42, preferably an end region 86 or 88 thereof.

Therefore, the second sensors 100 provide the control unit 72 with the possibility of determining whether the setting device 60 has adjusted the curving device 40 in accordance with the predetermined setting parameter E.

The association between the setting parameter E which is in each case required for setting the curving device 40 and the corresponding deflection D of the bending beam carrier 42 can in this case be defined as part of a calibration operation, in which in each case the rectilinear orientation of the bending beam tool 36 is reached under different levels of loads, and this information can be stored in the control unit 72 in the form of a table.

Therefore, the control unit is able to determine setting parameters E for the curving device 40 which correspond to different levels of deflection D of the bending beam carrier 42 that occur and for which the curving device 40 acts on the bending beam tool 36 in such a manner that the bending edge 44 thereof runs substantially in a straight line and parallel to the pivot axis 34 and therefore parallel to the bending line.

Figure 6:
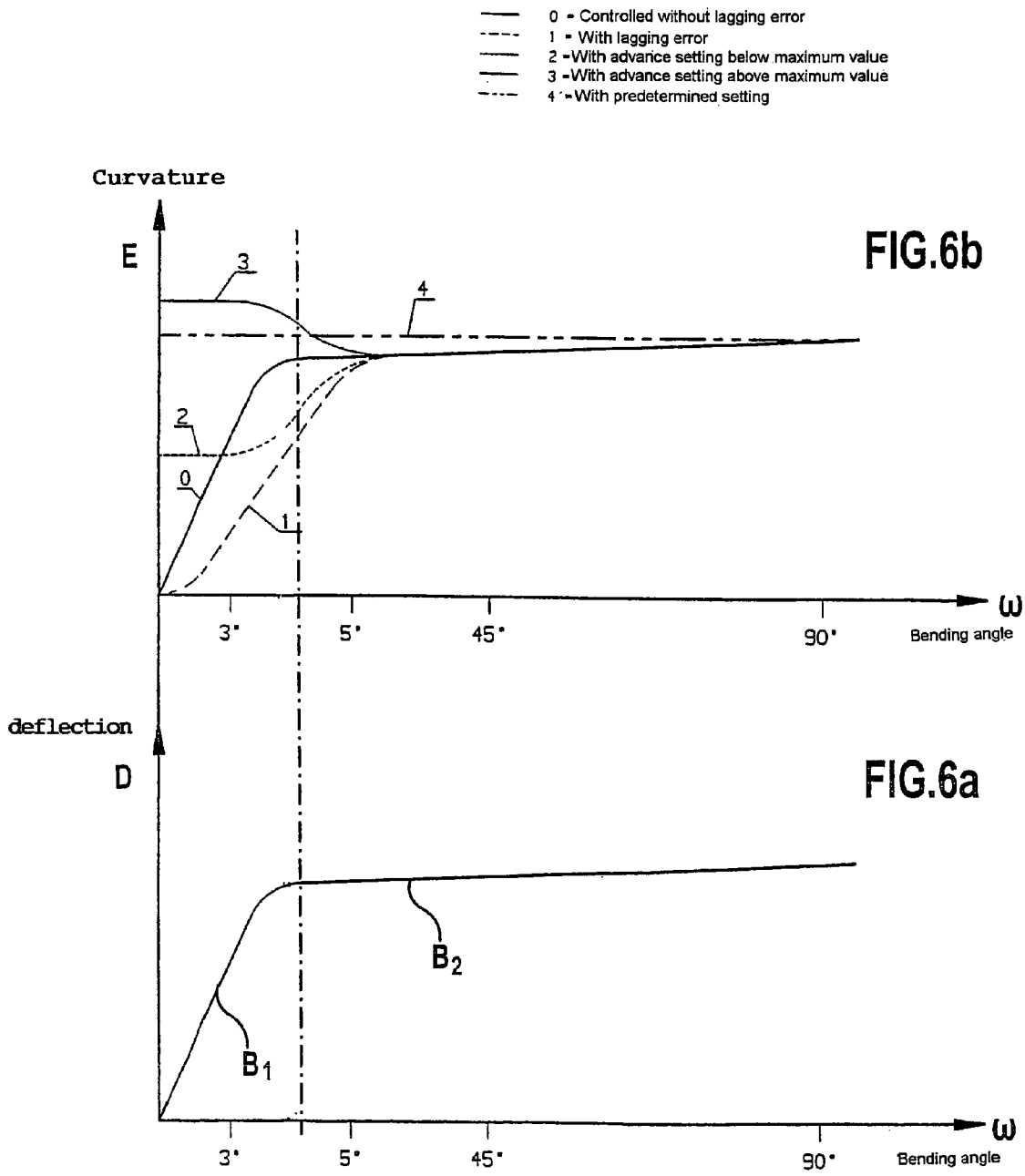
FIG. 6 in FIG. 6*a*: illustrates deflection of a bending beam carrier in a bending machine according to the invention during a bending operation up to a maximum bending angle.

The setting of the curving device 40 can take place in various operating modes, as illustrated in FIG. 6.

FIG. 6*a* illustrates the deflection D of the bending beam carrier 42 as a function of a bending angle W, i.e. a pivot angle about the pivot axis 34.

It can be seen from this figure that during bending up to an angle of, for example, 90° the deflection D initially, in a first bending angle range B1, rises approximately linearly with the bending angle W and then, for example at a bending angle W of approximately 4°, moves into a second bending range B2, in which an increase in the bending angle W is associated with only a slight, approximately linear rise in the deflection D of the bending beam carrier 42 as the bending angle W increases.

The transition from the bending range B1 to the bending range B2 is associated with the fact that when the yield point of the material of the workpiece 24 has been exceeded, the forces acting on the bending beam tool 36 increase only slightly as the bending angle W increases.

The control unit 72 can then predetermine different setting parameters in accordance with the profile of the deflection D against the bending angle W.

As illustrated by curve 0 in FIG. 6*b*, in a first operating mode the setting parameter E can be set by the control unit 72 to accurately follow the profile of the deflection D, provided that the setting device 60 operates sufficiently quickly to realize correspondingly fast readjustment of the curving device 40 when the bending angle W is passed through quickly.

Since this is difficult to achieve in many cases, in a second operating mode the setting parameter E is set with a certain delay or a certain lagging error at least during bending range B1, as illustrated by curve 1 in FIG. 6*b*, so that the setting parameter E only reaches the values corresponding to the deflection D in bending range B2 beyond a bending angle W of approximately 5°, but then the setting parameter E follows the deflection D until the maximum bending angle W is reached.

A lagging error of this type has no serious disadvantageous consequences for the accuracy of the bending operation, provided that the setting parameters E which correspond to the deflection D of the bending beam carrier 42 are reached by the end of the bending operation, since the bending beam tool 36 has nevertheless been corrected in terms of its deflection by the time the bending operation has ended, and therefore the bent-over strip 26, by the end of the bending operation, has also been bent in the same way as if the setting parameter E were to have been set exactly concurrently with the deflection D of the bending beam carrier 42.

Predetermining of the setting parameter E in the first operating mode in accordance with curve 0 or in the second operating mode corresponding to curve 1 in FIG. 6*b* usually takes place when the defined bending operation has been carried out for the first time by the bending machine, since in such a situation the control unit 72 does not usually have any starting point values whatsoever for the deflection D which is established at the bending beam carrier 42.

In general, however, the bending machines according to the invention will not be carrying out bending operations just once, but rather the same defined bending operation will be carried out repeatedly in succession, in each case on a new workpiece 24.

In this case, the control unit 72 already has available to it maximum values for the setting parameter E during this bending operation on the basis of the preceding bending operations.

For this reason, in a third operating mode—illustrated by curve 2 in FIG. 6—the control unit 72 can already preset the curving device 40, before the bending operation commences, with a setting parameter E which is below the maximum value. This setting parameter E is maintained as a constant value until this setting parameter E has been reached on account of the deflection D of the bending beam carrier 42 and is then adapted as the deflection D increases further; in this respect a lagging error may also occur, but this is rapidly reduced in bending range B2, so that toward the end of the bending operation the setting parameter E corresponds to the deflection of the bending beam carrier 42 which is established.

Since, if high bending forces occur, the readjustment of the curving device 40 such that the curvature gradually increases during the bending operation, i.e. the distance between the bending beam carrier 42 and the bending beam tool 36 increases more and more in the region of the center line 52, requires a high force from the setting device 60, it is provided in a fourth operating mode, represented by curve 3 in FIG. 6*b*, that the curving device 40 is preset by a setting parameter E in such a way that the curvature is greater than the curvature required. Then, starting with the bending operation, the curvature of the curving device 40 is reduced down to a value corresponding to the deflection D of the bending beam carrier 42 and if appropriate also readjusted slightly in bending range B2. This solution has the major advantage that the high forces required in the bending region B1 for the readjustment of the curvature of the curving device 40 can be avoided without detriment to the accuracy of the bending operation, since the setting parameter E corresponds to the deflection D of the bending beam carrier 42 at the end of the bending operation just as before.

If the order of magnitude of the setting parameter E which is present at the end of the bending operation is known to the control unit, the setting of the setting parameter E can also be effected when a workpiece 24 is being bent for the first time in accordance with a defined bending operation, in accordance with the third and fourth operating modes, i.e. in accordance with curves 2 and 3, respectively, from FIG. 6*b*.

If the final value for the setting parameter E that is to be set is known to the control unit 72 from a preceding bending operation, it is possible, during subsequent bending operations, even to dispense altogether with the determination of the deflection D of the bending beam carrier 42 and for the final value of the setting parameter E determined during a first bending operation to be fixedly set during the subsequent bending operations, as can be seen in a fifth operating mode, illustrated by curve 4 in FIG. 6*b*.

The invention claimed is:

1. Bending machine, comprising a machine frame, an upper beam and a lower beam, both of which are held on the machine frame and can move relative to one another, a bending beam, which is held on the machine frame and is moveable with respect to the machine frame, the bending beam being moveable relative to the upper beam and lower beam, the bending beam having a bending beam carrier and a bending beam tool that is supported on the bending beam carrier via a curving device actuable by a control unit, the curving device being able to bend the bending beam tool relative to the bending beam carrier in a direction opposite to the deflection of the bending beam carrier which occurs as a reaction of bending forces, the curving device being provided with a setting device operable during a bending operation, the control unit being adapted to actuate the setting device even during a bending operation, at least one sensor being provided, which is associated with the control unit and can be used by the control unit to determine a setting of the curving device by the setting device, and for a defined bending operation the control unit being adapted to determine at least one setting parameter for the curving device for which the bending beam tool is oriented substantially without any deflection when this bending operation has ended.

2. Bending machine according to claim 1, wherein the at least one setting parameter is the maximum setting parameter which occurs during the defined bending operation.

3. Bending machine according to claim 1, wherein the curving device can be set according to a multiplicity of setting parameters during the defined bending operation.

4. Bending machine according to claim 1, wherein the at least one setting parameter for a defined bending operation can be determined by a measurement by the control unit while this bending operation is being carried out.

5. Bending machine according to claim 1, wherein the control unit as part of a measurement for determining the at least one setting parameter records the deflection of the bending beam carrier by means of at least one sensor.

6. Bending machine according to claim 1, wherein the at least one sensor records the deflection of the bending beam carrier at a single location thereof.

7. Bending machine according to claim 1, wherein the control unit records the setting of the curving device by means of at least one position sensor associated with the curving device.

8. Bending machine according to claim 1, wherein the curving device can be set in accordance with the setting parameter by means of the control unit during a bending operation.

9. Bending machine according to claim 8, wherein the control unit, by actuation of the setting device, sets the curving device according to the deflection of the bending beam carrier which is established at individual times while the bending operation is being carried out.

10. Bending machine according to claim 1, wherein the curving device can be set in accordance with the setting parameter by means of the control unit while the setting parameter is being recorded.

11. Bending machine according to claim 1, wherein the curving device can be set to the at least one setting parameter before the defined bending operation is carried out.

12. Bending machine according to claim 1, wherein the curving device can be set according to the setting parameter in any operating state.

13. Bending machine according to claim 1, wherein the control unit at least approximately determines the at least one setting parameter before another of the defined bending operations is carried out.

14. Bending machine according to claim 1, wherein the control unit substantially precisely determines the at least one setting parameter before another of the defined bending operations is carried out.

15. Bending machine according to claim 1, wherein the curving device can be preset by means of the control unit before the defined bending operation is carried out.

16. Bending machine, comprising a machine frame, an upper beam and a lower beam, both of which are held on the machine frame and can move relative to one another, a bending beam, which is held on the machine frame, and is moveable with respect to the machine frame, the bending beam being moveable relative to the upper beam and lower beam, the bending beam having a bending beam carrier and a bending beam tool that is supported on the bending beam carrier via a curving device actuable by a control unit, the curving device being provided with a setting device operable during a bending operation, the control unit being adapted to actuate the setting device even during a bending operation, at least one sensor being provided, which is associated with the control unit and can be used by the control unit to determine a setting of the curving device by the setting device, and for a defined bending operation the control unit being adapted to determine at least one setting parameter for the curving device for which the bending beam tool is oriented substantially without any deflection when this bending operation has ended;

wherein the control unit as part of a measurement for determining the at least one setting parameter records the deflection of the bending beam carrier by means of at least one sensor; and wherein the at least one sensor records the deflection of the bending beam carrier with respect to a reference position.

17. Bending machine according to claim 16, wherein the reference position is predetermined by a reference element.

18. Bending machine according to claim 17, wherein the reference element is a reference carrier extending parallel to the bending beam carrier.

19. Bending machine according to claim 18, wherein the at least one sensor records a change in the relative position of the bending beam carrier with respect to the reference carrier.

20. Bending machine, comprising a machine frame, an upper beam and a lower beam, both of which are held on the machine frame and can move relative to one another, a bending beam, which is held on the machine frame, and is moveable with respect to the machine frame, the bending beam being moveable relative to the upper beam and lower beam, the bending beam having a bending beam carrier and a bending beam tool that is supported on the bending beam carrier via a curving device actuable by a control unit, the curving device being provided with a setting device operable during a bending operation, the control unit being adapted to actuate the setting device even during a bending operation, at least one sensor being provided, which is associated with the control unit and can be used by the control unit to determine a setting of the curving device by the setting device, and for a defined bending operation the control unit being adapted to determine at least one setting parameter for the curving device for which the bending beam tool is oriented substantially without any deflection when this bending operation has ended;

wherein the control unit as part of a measurement for determining the at least one setting parameter records the deflection of the bending beam carrier by means of at least one sensor; and wherein the control unit determines the setting parameter for the curving device on the basis of the deflection of the bending beam carrier and adjustment properties of the curving device.

21. Bending machine, comprising a machine frame, an upper beam and a lower beam, both of which are held on the machine frame and can move relative to one another, a bending beam, which is held on the machine frame and is moveable with respect to the machine frame, the bending beam being moveable relative to the upper beam and lower beam, the bending beam having a bending beam carrier and a bending beam tool that is supported on the bending beam carrier via a curving device actuable by a control unit, the curving device being provided with a setting device operable during a bending operation, the control unit being adapted to actuate the setting device even during a bending operation, at least one sensor being provided, which is associated with the control unit and can be used by the control unit to determine a setting of the curving device by the setting device, and for a defined bending operation the control unit being adapted to determine at least one setting parameter for the curving device for which the bending beam tool is oriented substantially without any deflection when this bending operation has ended;

wherein the curving device can be preset by means of the control unit before the defined bending operation is carried out; and wherein the curving device can be preset by means of the control unit to a value which is above an assumed setting parameter and can then be reduced to the actual setting parameter during the bending operation.

22. Bending machine according to claim 21, wherein the assumed setting parameter can be determined by the control unit in such a manner that the actual setting parameter determined after part of a bending angle associated with a bending operation has been passed through is used.

23. Bending machine, comprising a machine frame, an upper beam and a lower beam, both of which are held on the machine frame and can move relative to one another, a bending beam, which is held on the machine frame and is moveable with respect to the machine frame, the bending beam being moveable relative to the upper beam and lower beam, the bending beam having a bending beam carrier tool that is supported on the bending beam carrier via a curving device actuable by a control unit, the curving device being provided with a setting device operable during a bending operation, the control unit being adapted to actuate the setting device even during a bending operation, at least one sensor being provided, which is associated with the control unit and can be used by the control unit to determine a setting of the curving device by the setting device, and for a defined bending operation the control unit being adapted to determine at least one setting parameter for the curving device for which the bending beam tool is oriented substantially without any deflection when this bending operation has ended;

wherein the curving device can be preset by means of the control unit before the defined bending operation is carried out; and wherein the at least one setting parameter which has been determined once for a bending operation is used further by the control unit as setting parameter during others of the defined bending operations.

* * * * *

UNITED STATES PATENT AND TRADEMARK OFFICE

CERTIFICATE OF CORRECTION

PATENT NO. : 7,234,332 B2
APPLICATION NO. : 11/088442
DATED : June 26, 2007
INVENTOR(S) : Wolfgang Kutschker It is certified that error appears in the above-identified patent and that said Letters Patent is hereby corrected as shown below:

In Claim 23, Column 14, Line 12, insert --and a bending beam-- after the word “tool”.

Signed and Sealed this

Twenty-first Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 7,234,332 B2
APPLICATION NO. : 11/088442
DATED : June 26, 2007
INVENTOR(S) : Wolfgang Kutschker It is certified that error appears in the above-identified patent and that said Letters Patent is hereby corrected as shown below:

In Claim 23, Column 14, Line 12, insert --and a bending beam-- before the word "tool".

This certificate supersedes Certificate of Correction issued August 21, 2007.

Signed and Sealed this

Sixteenth Day of October, 2007

JON W. DUDAS
*Director of the United States Patent and Trademark Office*